US009981823B1

(12) United States Patent
Van Deurse et al.

(10) Patent No.: US 9,981,823 B1
(45) Date of Patent: May 29, 2018

(54) SAFETY CHUCK

(71) Applicants: Michael Van Deurse, Norton, MA (US); Nicholas Allard, Brockton, MA (US); Michael O'Shea, South Easton, MA (US); Brittany Cole, Dartmouth, MA (US); Steve Marsh, Brockton, MA (US)

(72) Inventors: Michael Van Deurse, Norton, MA (US); Nicholas Allard, Brockton, MA (US); Michael O'Shea, South Easton, MA (US); Brittany Cole, Dartmouth, MA (US); Steve Marsh, Brockton, MA (US)

( * ) Notice: Subject to any disclaimer, the term of this patent is extended or adjusted under 35 U.S.C. 154(b) by 355 days.

(21) Appl. No.: 14/962,813

(22) Filed: Dec. 8, 2015

Related U.S. Application Data

(60) Provisional application No. 62/088,938, filed on Dec. 8, 2014.

(51) Int. Cl.

| | |
|---|---|
| ***B65H 75/02*** | (2006.01) |
| ***B65H 16/06*** | (2006.01) |
| ***B65H 18/02*** | (2006.01) |

(52) U.S. Cl.
CPC ..... *B65H 75/02* (2013.01); *B65H 16/06* (2013.01); *B65H 18/028* (2013.01); *B65H 2301/41346* (2013.01)

(58) Field of Classification Search
CPC ..... B65H 16/06; B65H 18/028; B65H 75/02; B65H 2301/41346
See application file for complete search history.

(56) References Cited

U.S. PATENT DOCUMENTS

| | | | | |
|---|---|---|---|---|
| 3,777,999 A * | 12/1973 | Sciola | B65H 18/04 | 242/599.3 |
| 4,105,171 A * | 8/1978 | Sciola | B65H 16/06 | 242/914 |
| 4,438,554 A * | 3/1984 | Sciola | B65H 16/02 | 242/596.5 |
| 6,533,214 B1 * | 3/2003 | Guttin | B65H 16/06 | 242/571.3 |

FOREIGN PATENT DOCUMENTS

| | | | |
|---|---|---|---|
| EP | 0611715 A1 * | 8/1994 | B65H 16/06 |
| EP | 0709327 A1 * | 5/1996 | B65H 16/06 |
| FR | 2707274 A1 * | 1/1995 | B65H 16/06 |
| GB | 2337249 A * | 11/1999 | B65H 16/06 |

* cited by examiner

*Primary Examiner* — William E Dondero
(74) *Attorney, Agent, or Firm* — John P. McGonagle

(57) ABSTRACT

A safety chuck mounted to equipment that process web material is provided. The safety chuck is provided with a die spring connecting a moveable jaw with a spindle, said spring urging the moveable jaw into a fully closed position. A number of magnets mounted on a mounting flange will engage the moveable jaw, overcoming the spring's force and holding the moveable jaw in a fully open position. Rotation of the spindle releases the magnets allowing the spring to force the moveable jaw back into a fully closed position.

3 Claims, 8 Drawing Sheets

CLOSED POSITION 1
5
14
12
10
11
15
29
20
60
50
41
42
40

12
10
11
29
20
60
50
41
42

50
20
29
27
24
26
14
12

CLOSED POSITION

SAFETY CHUCK

BACKGROUND OF THE INVENTION

This invention relates to chucks, and in particular, to safety chucks mounted to equipment that processes web material such as sheets of film, paper, tissue, foil and the like.

During manufacturing and other operations, material may need to be mounted onto or off a roll. In conventional web treatments where machines handle reels of paper, plastics, metal foils, textiles and other sheet material, the cores of these reels must be mounted on the machines so that rotational drive can be selectively coupled to the cores to affect winding or unwinding of the web material entrained on the cores. The cores carrying the webs are normally tubular components. To affect the rotational drive to the core a shaft is generally inserted into and grips the core. Each end of the shaft then engages a chuck attached to a spindle rotationally attached to the machine.

The chucks are termed "safety" chucks when the chucks automatically grasp and close about the shaft ends and, when the machine starts rotating the spindles, prevent the roll from disengaging from the machine. Safety chucks generally are manually closed. If the machine starts with the safety chuck in an open position, prior art safety chucks employ a small sliding cam mechanism to close the safety chuck. These cam mechanisms are not very robust. After a few dozen to a hundred cycles, prior art cam mechanisms wear out. Another problem associated with prior art cam mechanisms is that the safety chuck is not completely closed. As the machine starts rotating, wear on the cam mechanism increases, thereby increasing the cumulative wear on the cam mechanism, shortening its life span.

SUMMARY OF THE INVENTION

The present invention overcomes the limitations of prior art safety chucks by providing a safety chuck which incorporates a closing spring(s) and magnets. An operator will manually open the safety chucks, applying force against the spring(s). In the full open position, magnets will make contact and hold the safety chuck in the full open position. A shaft is then inserted into a safety chuck pair. The machine is started. As the safety chuck with mated shaft turns, the magnets slide apart and release. The spring(s) then force the chuck fully closed.

DETAILED DESCRIPTION OF INVENTION

Figures 1, 2, 3:
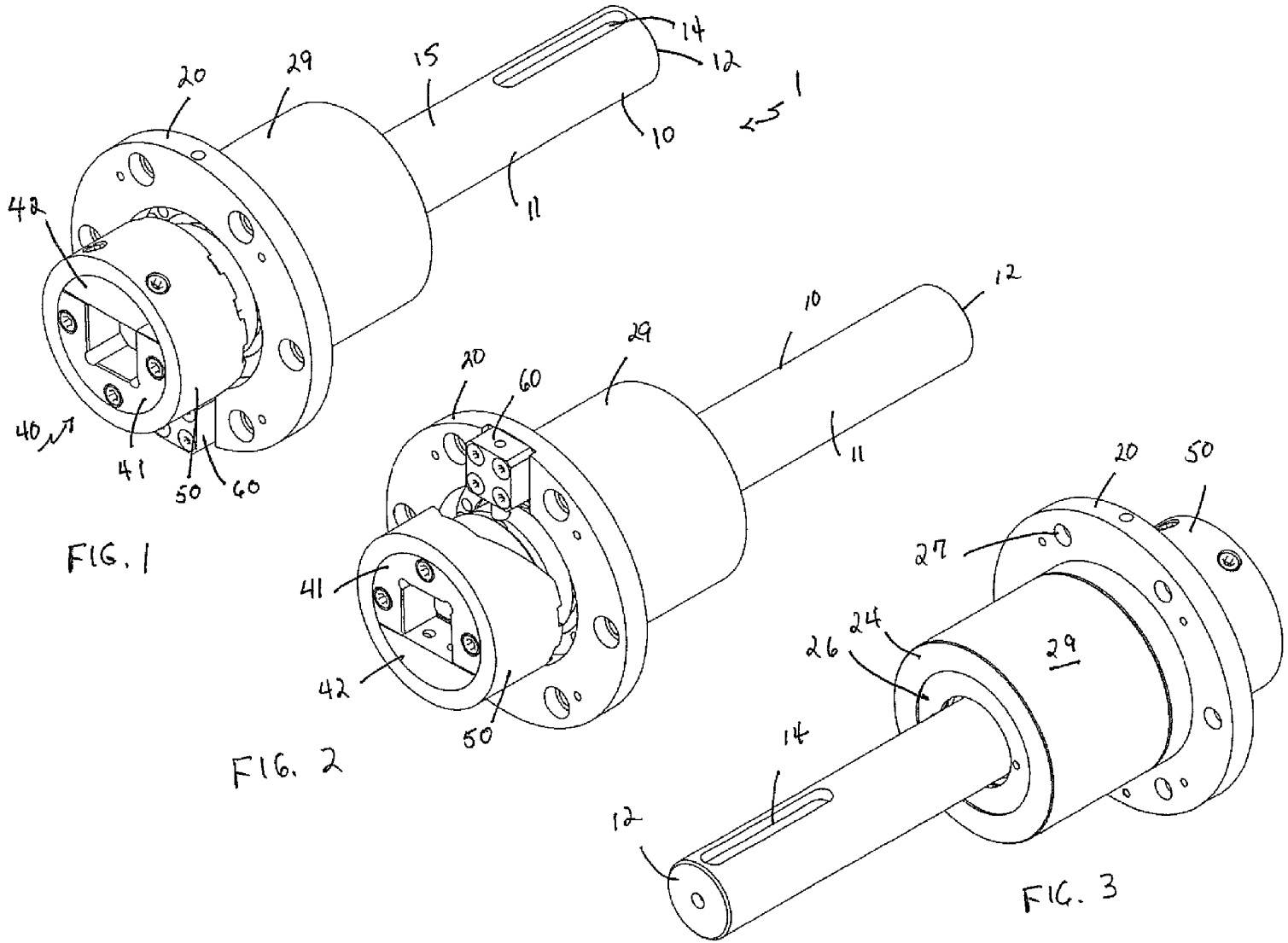
FIG. 1 is a front perspective view of an invention safety chuck.
FIG. 2 is a front perspective view of the invention safety chuck of FIG. 1 rotated 180°.
FIG. 3 is a rear perspective view of the invention safety chuck shown in FIG. 1.
Figure 5:
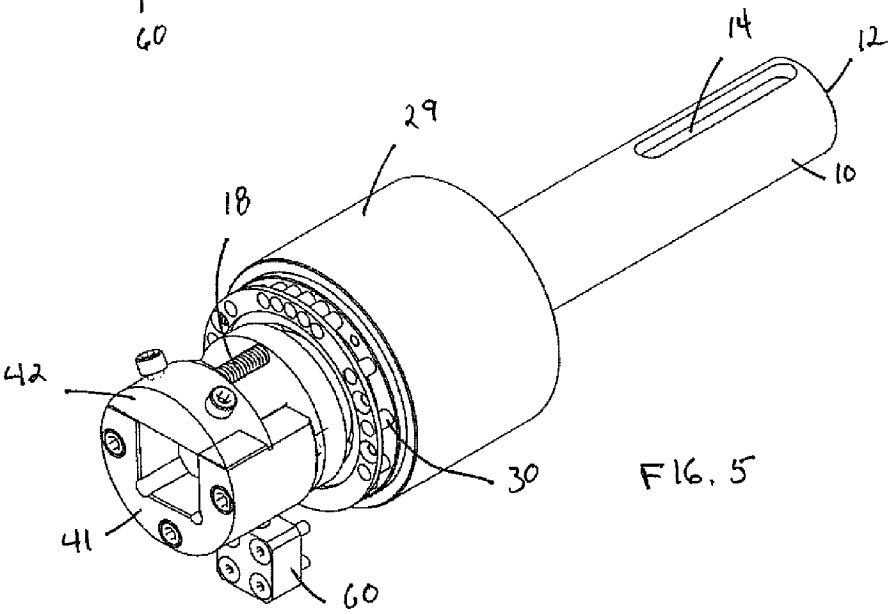
FIG. 5 is a front perspective view of the safety chuck of FIG. 1 without the mounting flange exterior.
Figure 4:
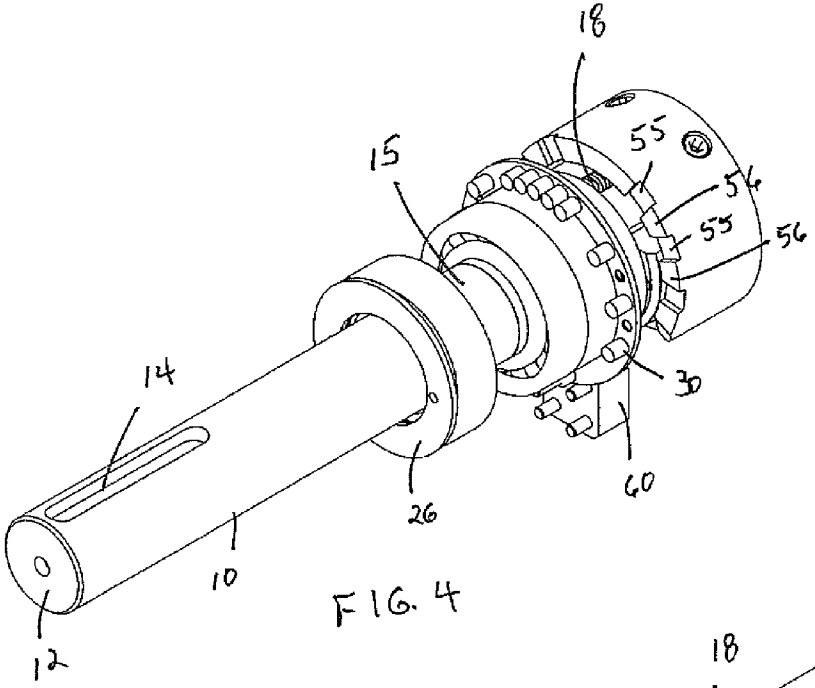
FIG. 4 is a rear perspective view of the safety chuck of FIG. 3 without the mounting flange exterior.
Figure 6:
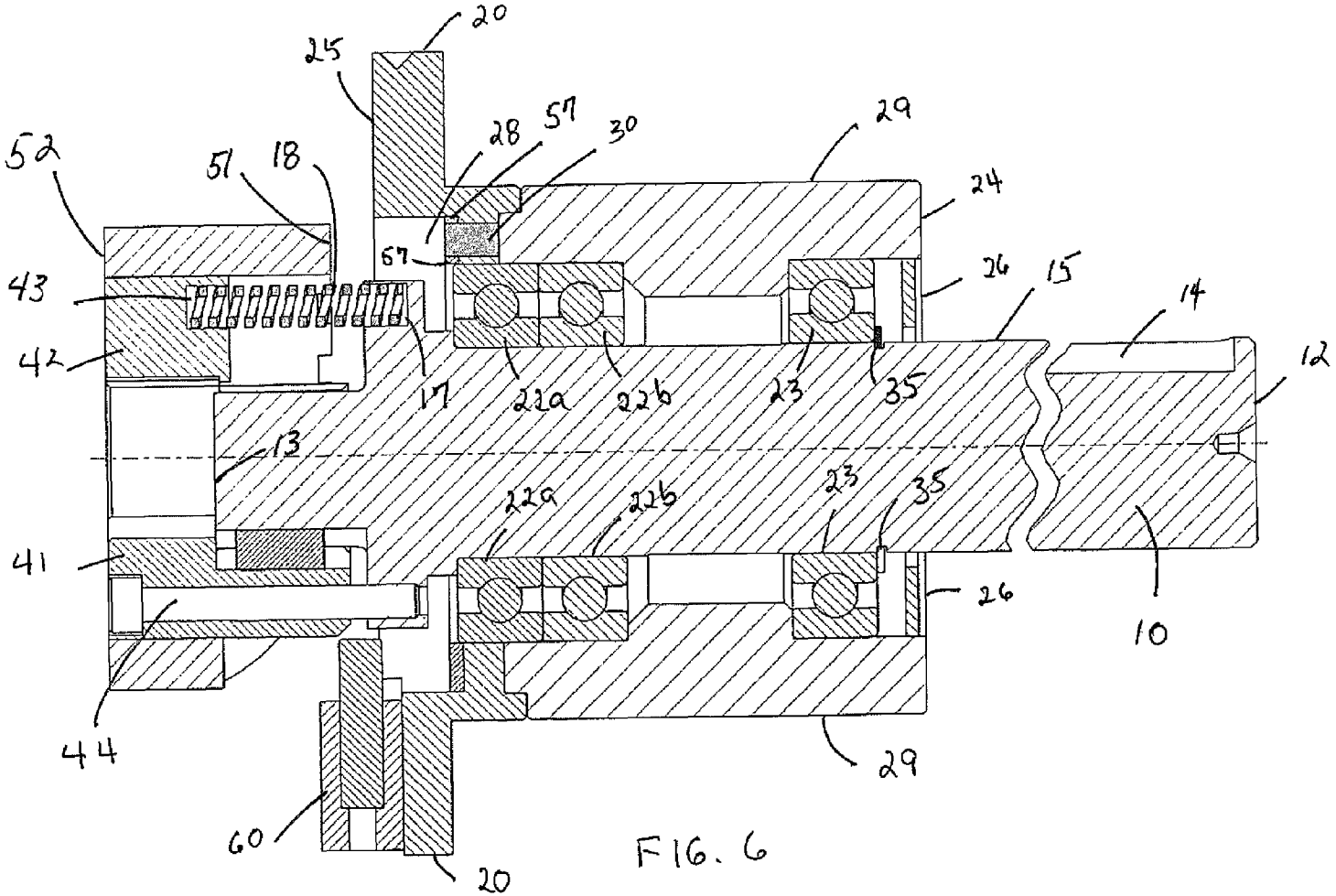
FIG. 6 is a cross sectional view of the safety chuck of FIG. 1 in a closed position.

Referring to the drawings in detail wherein like elements are indicated by like numerals, there is shown a safety chuck 1 comprising a spindle 10, held by a mounting flange 20, said spindle terminating in a jaw assembly 40.

The spindle 10 has an elongated, generally cylindrical body 11 with a proximal end 12 and a distal end 13, said proximal and distal ends defining a spindle longitudinal axis. The spindle body 11 is held by an annular mounting flange attachable to a work machine frame (not shown). A jaw assembly 40 is attached to the spindle distal end 13. The spindle body 11 has a key way 14 adapted to engage a work machine rotational element (not shown). The key way 14 is an elongated channel along a spindle body surface 15 parallel to the spindle longitudinal axis, said key way beginning near to the spindle proximal end 12.

The annular mounting flange has a cylindrical housing 29 leading to a rear surface 24, said rear surface 24 facing the spindle proximal end 12. The mounting flange has a front surface 25 formed into a flange in front of the housing 29. The annular mounting flange 20 has a central, ring-like aperture 21 formed therein. The spindle body 11 fits within the aperture 21. Three rings of ball bearings, two forward rings 22*a* and 22*b*, and a rearward ring 23 are positioned within the aperture 21 against the spindle surface 15 beneath the housing 29. A retaining clip 35 holds the bearings 22 & 23 in place about the central aperture 21. An annular dust shield 26 is placed within the aperture 21 beneath the housing 29 at the main body rear surface 24 to protect the ball bearing rings 22, 23. Attachment means 27 are provided within the annular mounting flange, said attachment means adapted to provide attachment to the work machine frame (not shown). The annular mounting flange 20 supports a rotating spindle 10 without itself moving, the ball bearings allowing spindle rotation while also providing spindle support. The spindle distal end 13 terminates within the annular mounting flange central aperture 21 past the mounting flange front surface 25.

The jaw assembly 40 is comprised, in part, of a static jaw 41 fixedly bolted 44 to the spindle 10 and extending forward of the spindle distal end 13. The jaw assembly is also comprised of a complimentary moveable jaw 42 encased in a moveable, cylindrical shroud 50. The shroud 50 has a rear surface 51, facing the mounting flange front surface 25, and an opposite front surface 52. The shroud 50 has a central aperture 53 with the attached moveable jaw 42 fixedly attached thereto. The shroud central aperture 53 is slideable over the spindle front distal end 13 and static jaw 41, through the mounting flange front surface 25, a desired distance into the mounting plate interior 28. The shroud 50 is in a fully closed position when the shroud is forward enough that the moveable jaw 42 is aligned with the static jaw 41.

The spindle distal end 13 has a spring aperture 17 formed therein, said aperture 17 off-center from a central spindle longitudinal axis. The moveable jaw 42 has a corresponding spring aperture 43 formed therein. A single die spring 18 is inserted into the spring apertures 17, 43, said spring 18 forcing the shroud 50 into a fully closed position, thereby locking the jaws 41, 42 onto a shaft end.

Figure 7:
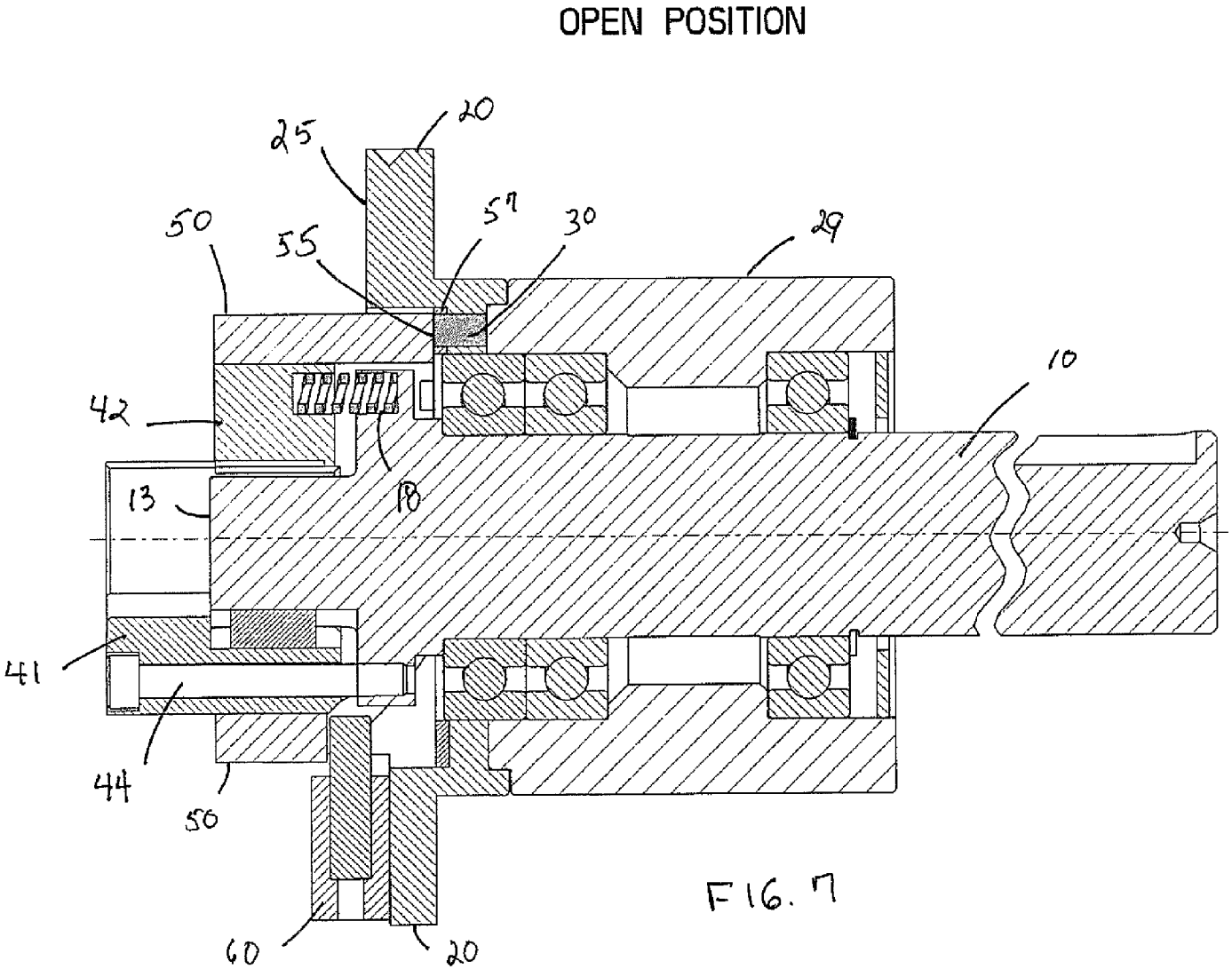
FIG. 7 is a cross sectional view of the safety chuck of FIG. 1 in an open position with a magnet aligned to "catch".
Figure 8:
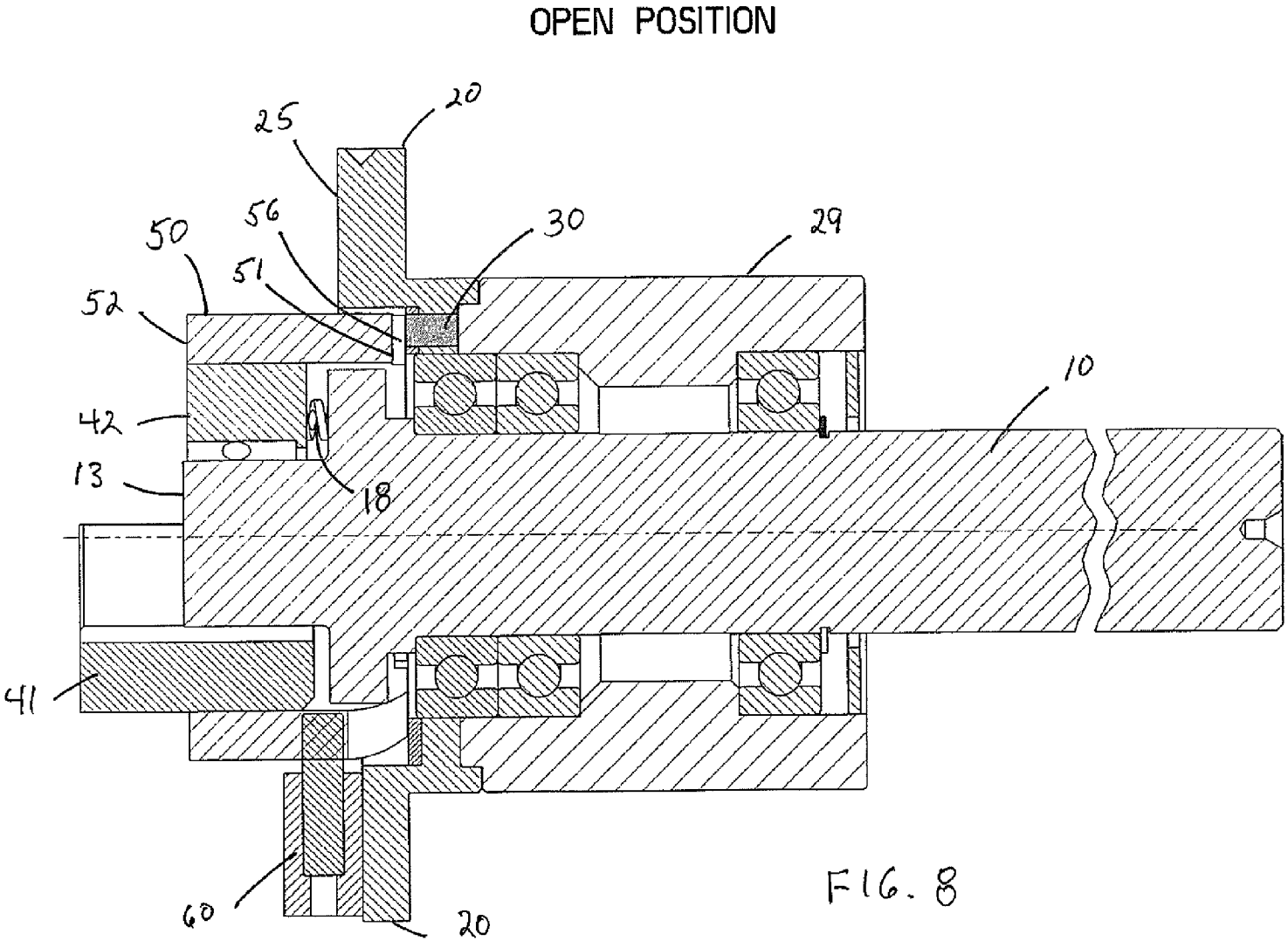
FIG. 8 is a cross sectional view of the safety chuck of FIG. 1 in an open position, but with the magnet aligned to "release".

The mounting flange 20 has a plurality of magnets 30 attached thereto about the central aperture 21 and facing toward the shroud rear surface 51. The shroud rear surface 51 is made from ferrous material 55. The shroud faceplate ferrous rear surface 55 has a plurality of open slots 56 formed therein, said slots spaced about the faceplate rear surface 51. The magnets 30 are adapted to magnetically engage the faceplate ferrous rear surface 55 when the faceplate rear surface 51 engages the mounting flange interior 28. See FIG. 7. As the shroud 50 is rotated and the magnets 30 are aligned with the faceplate open apertures 56, the magnetic engagement is broken. See FIG. 8.

The magnetic engagement is most powerful when there is direct contact, however the resulting normal force of direct contact would create friction resistance, which would increase the required torque that needs be transmitted between the safety chuck to the shaft over to the other safety chuck. Therefore, a separation, i.e., a few thousandths of an inch, between the magnets and the shroud ferrous rear surface 55 is desired. Furthermore, the magnets are brittle, so it is desirable that the magnets not actually touch the shroud ferrous surface 55. To prevent actual touching between the magnets 30 and the faceplate ferrous rear surface 55, a non-ferrous mechanical stop 57 is formed on the mounting flange about each magnet 30, thereby controlling the closeness of the magnets 30 to the ferrous material 55 when the faceplate 50 is in an open position. The mechanical stop restriction prevents the magnets from scraping against the faceplate ferrous material 55 and overcoming inertia.

In operation, the rotation of the shaft within the safety chuck 1 ceases. The shroud 50 is manually moved from a closed position to an open position, thereby moving the moveable jaw 42 away from the static jaw 41. The mounting flange magnets 30 engage the shroud rear surface ferrous material 55, thereby overcoming the spring 18 tension and holding the shroud 50 open. When a new shaft is placed onto the static jaw 41, rotation of the shroud 50 brings the shroud rear open apertures 56 into alignment with the magnets 30, thereby breaking the magnetic attraction holding the shroud and attached moveable jaw in an open position. The tension of the spring 18 forces the shroud 50 and moveable jaw 42 forward into a closed position bringing the two jaws 41, 42 into alignment over the shaft end.

The advantage of the off-center spring location is that the spring 18 is in direct alignment with the moveable jaw 42. However, the invention structure must accommodate commercially available springs. For a wider latitude in spring selection, the spring location may be aligned with the central longitudinal axis of the spindle.

Figure 9:
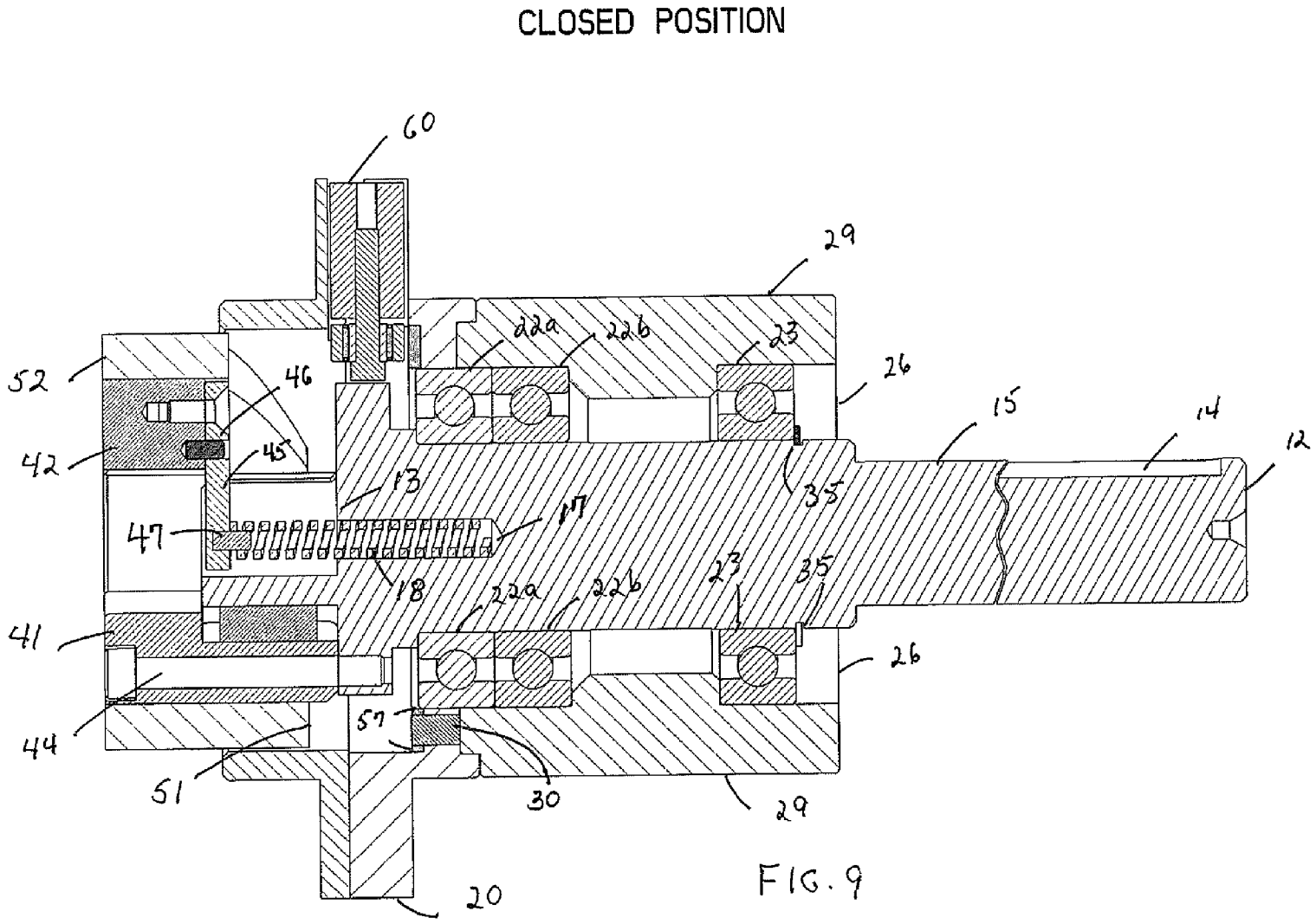
FIG. 9 is a cross sectional view of the safety chuck of FIG. 1 with a central spring and in a closed position.
Figure 10:
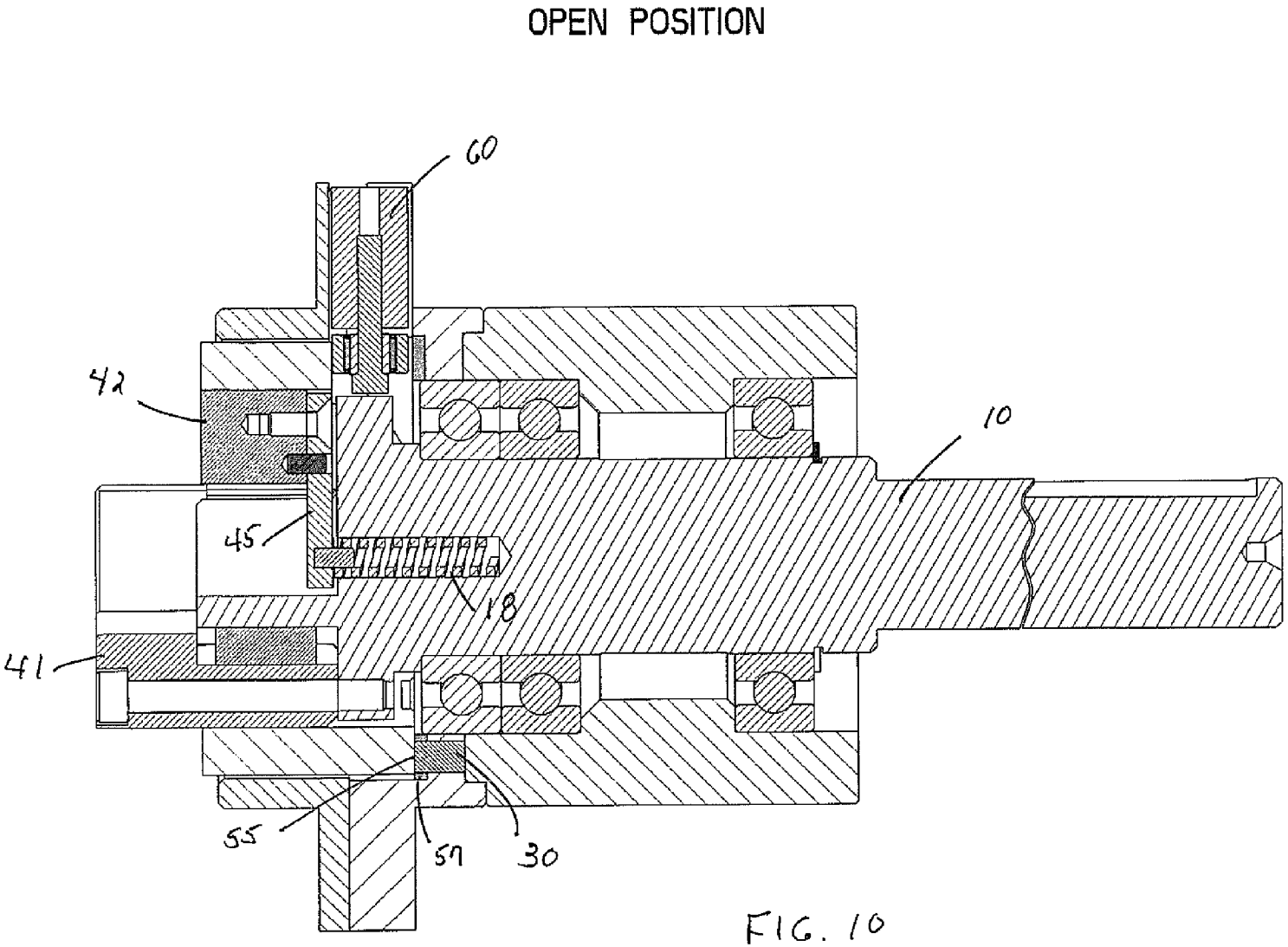
FIG. 10 is a cross sectional view of the safety chuck of FIG. 1 with a central spring and in an open position with a magnet aligned to "catch".
Figure 11:
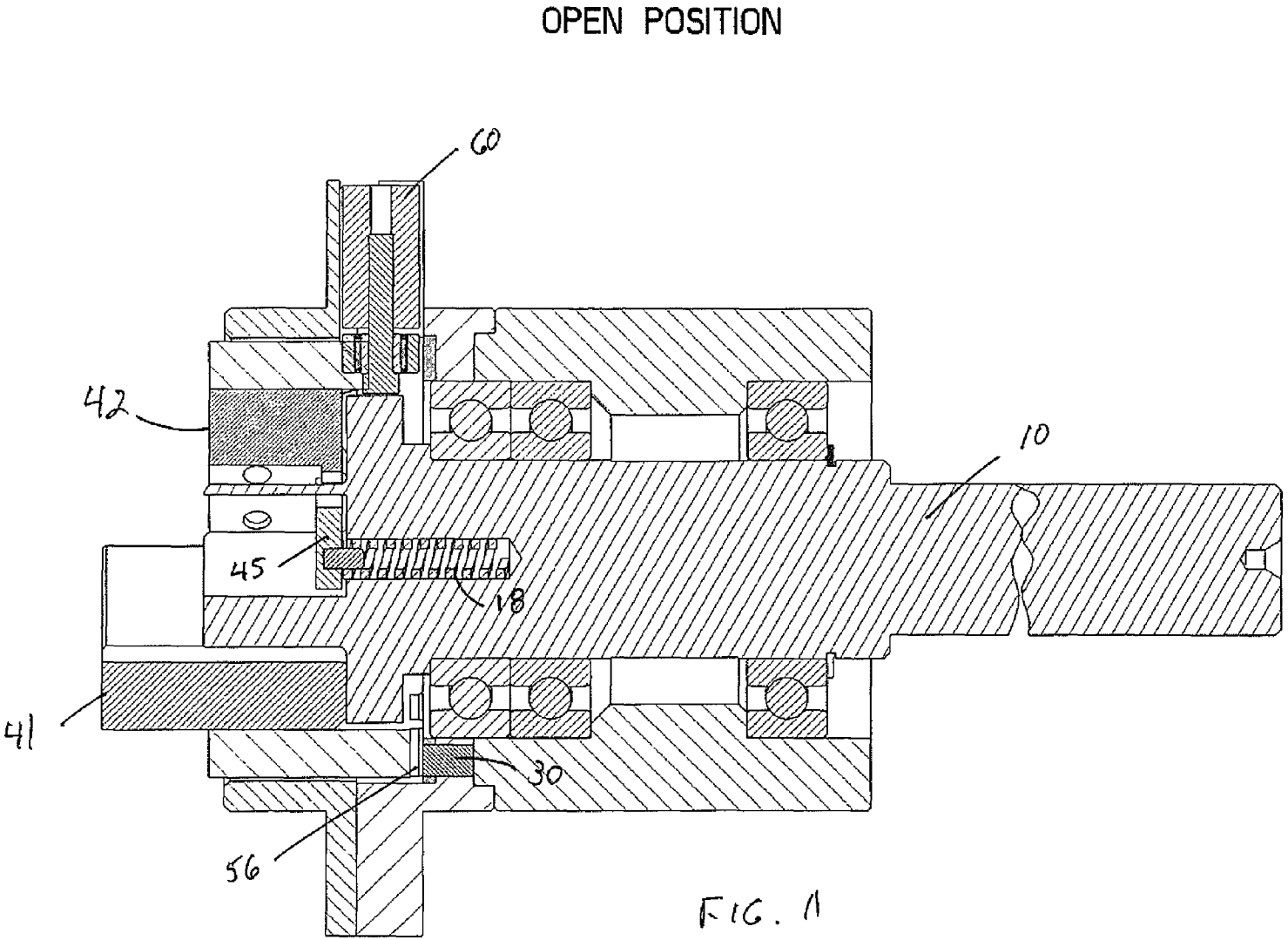
FIG. 11 is a cross sectional view of the safety chuck of FIG. 1 with a central spring and in an open position, but with the magnet aligned to "release".

Referring to the drawings in detail, with specific emphasis on FIGS. 9-11, there is also shown a safety chuck 1 with a central spring arrangement. The spindle distal end 13 has a spring aperture 17 formed therein, said aperture 17 formed along a central spindle longitudinal axis. The moveable jaw 42 has a tab 45 fixedly attached to a rear moveable jaw portion 46, said tab extending radially toward a mounting flange central axis. The tab has a spring aperture 47 corresponding to the spindle spring aperture 17. A single die spring 18 is inserted into the spring apertures 17, 47, said spring 18 forcing the moveable jaw 42 and attached shroud 50 forward into a fully closed position, thereby locking the jaws 41, 42 onto a shaft end. See FIG. 9.

The mounting flange 20 has a plurality of magnets 30 attached thereto about the central aperture 21 and facing toward the shroud rear surface 51. The shroud rear surface 51 is made from ferrous material 55. The shroud faceplate ferrous rear surface 55 has a plurality of open slots 56 formed therein, said slots spaced about the faceplate rear surface 51. The magnets 30 are adapted to magnetically engage the faceplate ferrous rear surface 55 when the faceplate rear surface 51 engages the mounting flange interior 28. See FIG. 10. As the shroud 50 is rotated and the magnets 30 are aligned with the faceplate open apertures 56, the magnetic engagement is broken. See FIG. 11.

It is understood that the above-described embodiments are merely illustrative of the application. Other embodiments may be readily devised by those skilled in the art, which will embody the principles of the invention and fall within the spirit and scope thereof. It may be desirable to install a redundant cam 60 in the mounting flange 20 in case of spring failure. The faceplate open apertures 56 may be replaced with sections of non-ferrous material. A seal, wiper or brush may be installed within the safety chuck to keep debris off of the magnets. Other spring and/or magnet configurations may be used to obtain the same functionality as described above.

We claim:

1. A safety chuck mounted to equipment that process web material, comprising:

a spindle having an elongated, generally cylindrical body with a proximal end and a distal end, said proximal and distal ends defining a spindle longitudinal axis, said spindle distal end terminating in said jaw assembly, said spindle distal end having a spring aperture formed therein along the spindle longitudinal axis, said moveable jaw having a tab fixedly attached to a rear moveable jaw portion, said tab extending radially toward a mounting flange central axis, said tab having a spring aperture formed therein corresponding to the spindle spring aperture;

a jaw assembly having a static jaw fixedly attached to the spindle and extending forward of the spindle distal end, and a complimentary moveable jaw encased in a moveable, cylindrical shroud, said shroud having a rear surface facing an annular mounting flange front surface, and an opposite front surface, said shroud having a central aperture with the moveable jaw fixedly attached thereto, said shroud central aperture slideable over the spindle front distal end and static jaw, through the mounting flange front surface, a desired distance into an annular mounting flange interior, wherein the shroud is in a fully closed position when the shroud and moveable jaw are aligned with the static jaw;

an annular mounting flange holding said spindle, said annular mounting flange having a cylindrical housing leading to an annular mounting flange rear surface, said annular mounting flange rear surface facing the spindle proximal end, said annular mounting flange front surface formed into a flange in front of the housing, said annular mounting flange having a central, ring-like aperture formed therein, wherein the spindle body fits within the central ring-like aperture, wherein the spindle distal end terminates within the annular mounting flange central aperture past the mounting flange front surface;

a plurality of ball bearing rings positioned beneath a cylindrical housing within the central ring-like aperture against a spindle body surface;

a single die spring inserted into the spindle and moveable jaw tab spring apertures, said die spring forcing the shroud into a fully closed position;

a plurality of magnets attached about the mounting flange central aperture and facing toward the shroud rear surface, said shroud rear surface made from ferrous material, said shroud rear surface having a plurality of open slots formed therein, said slots spaced about the shroud rear surface, said magnets adapted to magnetically engage the shroud rear surface when the shroud rear surface engages the mounting flange interior, wherein as the shroud is rotated and the magnets become aligned with the open slots, magnetic engagement is broken.

2. A safety chuck as described in claim 1, further comprising;

a non-ferrous mechanical stop formed on the mounting flange about each magnet.

3. A safety chuck as described in claim 2, further comprising:

a redundant sliding cam mechanism in the mounting flange.

* * * * *